US007398730B2

(12) United States Patent
Schrauwers

(10) Patent No.: US 7,398,730 B2
(45) Date of Patent: Jul. 15, 2008

(54) PRINTING CYLINDER SUPPORT UNIT, POSITIONING ELEMENT, PRINTING CYLINDER PROVIDED WITH POSITIONING ELEMENT, PRINTING MACHINE PROVIDED WITH PRINTING CYLINDER SUPPORT UNIT, AND ITS USE

(75) Inventor: Carolus Josephus Antonius Maria Schrauwers, Overloon (NL)

(73) Assignee: Stork Prints B.V., Boxmeer (NL)

( * ) Notice: Subject to any disclaimer, the term of this patent is extended or adjusted under 35 U.S.C. 154(b) by 197 days.

(21) Appl. No.: 11/189,302

(22) Filed: Jul. 26, 2005

(65) Prior Publication Data

US 2006/0021531 A1 Feb. 2, 2006

(30) Foreign Application Priority Data

Jul. 28, 2004 (NL) ..... 1026736

(51) Int. Cl.
*B41F 13/20* (2006.01)
*B41F 13/34* (2006.01)
*B41F 13/30* (2006.01)
*B41F 13/32* (2006.01)

(52) U.S. Cl. ..... 101/216; 101/349.1; 101/480

(58) Field of Classification Search ..... 101/216, 101/212, 477

See application file for complete search history.

(56) References Cited

U.S. PATENT DOCUMENTS 2,581,593 A * 1/1952 Luttenauer ..... 101/216
3,593,662 A * 7/1971 Gates ..... 101/218
4,676,158 A * 6/1987 Ishii et al. ..... 101/218
4,878,427 A 11/1989 Washchynsky et al.
5,392,709 A * 2/1995 Seyffert et al. ..... 101/216
5,546,860 A * 8/1996 Riis ..... 101/247
5,564,336 A * 10/1996 Straubinger et al. ..... 101/152
5,816,150 A * 10/1998 Sarda ..... 101/142
6,227,111 B1 * 5/2001 Dawley et al. ..... 101/218
6,230,620 B1 * 5/2001 Christmann et al. ..... 101/216
6,382,092 B1 * 5/2002 Van Den Brink et al. .... 101/116
6,418,845 B1 * 7/2002 Satoh et al. ..... 101/216
6,543,357 B2 * 4/2003 Schroeder ..... 101/349.1

(Continued)

FOREIGN PATENT DOCUMENTS

DE 7811182 8/1978

(Continued)

*Primary Examiner*—Daniel J Colilla
(74) *Attorney, Agent, or Firm*—Hoffmann & Baron, LLP

(57) ABSTRACT

The printing cylinder support unit for a printing machine according to the invention comprises a support frame, supporting means mounted on the support frame, and one of a plurality of positioning elements. The supporting means comprise displacement means and at least three support elements for each axial end of a printing cylinder, which support elements are designed each to interact with the positioning element at the location of a support point on the positioning element. The positioning element can be connected to one of a plurality of printing cylinders, the positions of the support points being related to the diameter of the printing cylinder in question. The displacement means are designed to move at least two of the support elements with respect to the support frame so as to receive positioning elements with different support point positions. The positioning element can be connected to the support elements in a rotationally fixed manner and comprises axle support means for accommodating a rotation axle of one of the printing cylinders.

15 Claims, 6 Drawing Sheets

U.S. PATENT DOCUMENTS

| | | | | |
|---|---|---|---|---|
| 6,694,877 | B1 * | 2/2004 | Wolters et al. | 101/218 |
| 6,868,779 | B2 * | 3/2005 | Schrauwers | 101/116 |
| 7,096,783 | B2 * | 8/2006 | Schrauwers | 101/216 |
| 2006/0201351 | A1 * | 9/2006 | Gross et al. | 101/216 |

FOREIGN PATENT DOCUMENTS

| | | |
|---|---|---|
| DE | 4401300 | 8/1994 |
| EP | 0864421 | 9/1998 |
| EP | 1092536 | 4/2001 |
| EP | 1285753 | 2/2003 |
| FR | 2342160 | 9/1977 |
| WO | WO2004/022339 | 3/2004 |
| WO | WO2004/050365 | 6/2004 |
| WO | WO2004/050366 | 6/2004 |

* cited by examiner

"Prior Art"

"Prior Art"

"Prior Art"

PRINTING CYLINDER SUPPORT UNIT, POSITIONING ELEMENT, PRINTING CYLINDER PROVIDED WITH POSITIONING ELEMENT, PRINTING MACHINE PROVIDED WITH PRINTING CYLINDER SUPPORT UNIT, AND ITS USE

The invention relates to a printing cylinder support unit for a printing machine which comprises a support frame and supporting means mounted on the support frame.

A printing cylinder support unit of this type is known from EP 0 864 421 A1. This document discloses a printing machine with exchangeable ink applicator means. A printing machine of this type comprises a plurality of printing units, in which each printing unit performs a separate function in the overall printing process. Printing units of this type can be suitable for various different printing formes with different repeat lengths and suitable for different printing technologies, such as rotary screen printing, intaglio printing, letterpress printing and flexographic printing. A printing unit generally comprises a printing cylinder support unit, a printing cylinder and ink applicator means. In the operating state, the printing cylinder comes into contact with a substrate that is to be printed along a describing line on the surface of the cylinder, the contact line. Ink is applied to the inner side, or directly to the outer side, of the printing cylinder via the ink applicator means.

With the known printing cylinder support unit, the printing cylinder rests rotatably in a circumferential bearing arrangement comprising three rollers which radially enclose a round end ring or bearing ring. This bearing ring is secured concentrically to the axial end of the printing cylinder. A bearing ring of this type supported by three rollers is also present at the other end of the printing cylinder.

In the prior art, it is possible to exchange printing cylinders. The purpose of exchanging a printing cylinder may be to allow a different repeat length to be printed. For this purpose, it is advantageous to use a printing cylinder with a different diameter. It is also possible to exchange a printing cylinder in order to change design or to change printing technique.

One drawback of the known printing cylinder support unit is that it is only suitable for receiving printing cylinders which are provided with a bearing ring. Bearing rings of this type are in practice primarily fitted to cylindrical screen-printing formes. Printing formes for other printing methods, however, are generally provided with a rotation axle which extends along the centre axis of the cylindrical printing forme in question. Although in practice there is considered to be a demand for printing formes of this type also to be received in the printing cylinder support unit of the prior art, this does not happen since it is relatively expensive to provide a printing forme of this type with end rings.

It is an object of the present invention to provide a printing cylinder support unit in which the abovementioned drawbacks are eliminated, or at least to provide an alternative.

In particular, it is an object of the present invention to provide a printing cylinder support unit which is suitable for receiving printing formes with rotation axles.

According to the invention, this object is achieved by means of a printing cylinder support unit comprising a support frame, and supporting means mounted on the support frame, in which unit the supporting means comprise displacement means and at least three support elements for an axial end of one of a plurality of printing cylinders with different diameters, the support elements each comprise an engagement point for interacting with a positioning element at the location of a support point on the positioning element, the positioning element being connectable to the printing cylinder, the positions of the support points being related to the diameter of the printing cylinder in question, and the displacement means are designed to move at least two of the support elements with respect to the support frame so as to receive positioning elements with different support point positions, corresponding to the different sized printing cylinders, wherein the positioning element can be connected to the support elements in a rotationally fixed manner, and comprises axle support means for accommodating a rotation axle of one of the printing cylinders.

The printing cylinder support unit for a printing machine according to the invention comprises a support frame, supporting means mounted on the support frame, and one of a plurality of positioning elements. The supporting means comprise displacement means and at least three support elements for each axial end of a printing cylinder, which support elements are each designed to interact with the positioning element at the location of a support point on the positioning element. The positioning element can be connected to one of a plurality of printing cylinders, the positions of the support points being related to the diameter of the printing cylinder in question. The displacement means are designed to move at least two of the support elements with respect to the support frame so as to receive positioning elements with different support point positions. The positioning element can be connected to the support elements in a rotationally fixed manner and comprises axle support means for accommodating a rotation axle of one of the printing cylinders.

The rotationally fixed connection of the positioning element to the support elements, and the fact that this positioning element is provided with axle support means, makes it possible to receive printing cylinders with an axle each time. On account of the positions of the support points and the way in which the displacement means are designed, these axle support means are located at a position in the printing cylinder support unit which is such that the printing cylinders of different diameters that are to be received are positioned correctly in the printing cylinder support unit. This means that these cylinders adopt a desired position with respect to the remainder of the printing machine and the impression cylinder which is present therein.

In particular, at least one of the support elements can be frictionally connected to the positioning element. This is a surprisingly simple way of receiving the positioning element in a rotationally fixed manner.

More particularly, at least one of the support elements is at least partially in the shape of a roller, which support element is mounted in a rotationally fixed manner with respect to the support frame. By virtue of this shape, the support element which is at least partially in the shape of a roller supports the positioning element at the same support point position as a rotating roller as used for a circumferential bearing arrangement. By virtue of the fact that the support element is mounted fixedly in terms of rotation, it can, despite being in the shape of a roller, still be frictionally connected to the positioning element.

In a variant, at least one of the support elements can be connected in a positively locking manner to the positioning element. A positively locking connection is a reliable way of rotationally fixed holding. In addition, it is possible for the same support points which are used for a circumferential bearing arrangement to be connected in a positively locking manner to an adaptor element without many modifications.

In one embodiment, the axle support means comprise bearing means for rotatably accommodating the rotation axle of one of the printing cylinders. This makes it possible to receive the printing cylinders which are fixedly connected to their rotation axle.

The positioning element advantageously comprises a substantially round disc. On account of the fact that a round disc can have the same circumference as a bearing ring of a circumferential bearing arrangement, it is in this way possible to achieve the same positioning of printing cylinders with rotation axles as that achieved with bearing rings.

The invention also relates to a printing cylinder support unit for a printing machine which comprises a support frame, and supporting means mounted on the support frame. The supporting means comprise displacement means and at least three support elements for an axial end of one of a plurality of printing cylinders with different diameters. The support elements each comprise an engagement point for interacting with a positioning element at the location of a support point on the positioning element. The positioning element can be connected to the printing cylinder, the positions of the support points being related to the diameter of the printing cylinder in question. The displacement means are designed to move at least two of the support elements with respect to the support frame so as to receive positioning elements with different support point positions, corresponding to the different sized printing cylinders. Ink applicator means are provided on the displacement means of one of the support elements.

Providing the ink applicator means at this position means that there is no need for separate displacement means to adapt the position of the ink applicator means with respect to the support frame to the diameter of the printing cylinder received. On account of the fact that the displacement means already ensure that the support element in question interacts with a support point, the position of which depends on the diameter of the printing cylinder in question, the ink applicator means always adopt substantially the same position with respect to the outer surface of the printing cylinder in question even when using printing cylinders with different diameters. Once the ink applicator means have been set with respect to the displacement means, the ink applicator means are automatically positioned when a printing cylinder is replaced with a printing cylinder with a different diameter. This shortens the changeover time and reduces the adjustment section before the correct print settings are established.

In particular, the displacement means on which the ink applicator means are provided can move along a straight displacement line which intersects each of the printing cylinders which can be received at the same circumferential position. As a result, not only the position but also the orientation of the ink applicator means with respect to the printing cylinder is always identical.

The invention also relates to a positioning element which can be connected in a rotationally fixed manner to the support elements of a printing cylinder support unit according to the invention. The positioning element comprises axle support means for receiving a rotation axle of one of the printing cylinders. With a positioning element of this type, it is easy for a printing cylinder with a rotation axle connected to it to be received in a printing cylinder support unit which was originally intended to receive printing cylinders in a circumferential bearing arrangement.

The invention also relates to a printing cylinder provided with a positioning element which can be connected in a rotationally fixed manner to the support elements of a printing cylinder support unit according to the invention.

Moreover, the invention relates to a printing machine provided with a printing cylinder support unit, which comprises a support frame, and supporting means mounted on the support frame, in which unit the supporting means comprise displacement means and at least three support elements for an axial end of one of a plurality of printing cylinders with different diameters, the support elements each comprise an engagement point for interacting with a positioning element at the location of a support point on the positioning element, the positioning element being connectable to the printing cylinder, the positions of the support points being related to the diameter of the printing cylinder in question, and the displacement means are designed to move at least two of the support elements with respect to the support frame so as to receive positioning elements with different support point positions, corresponding to the different sized printing cylinders, wherein ink applicator means are provided on the displacement means of one of the support elements.

The invention also relates to the use of a printing cylinder support unit in a printing machine where the printing cylinder support unit comprises a support frame and supporting means mounted on the support frame, in which unit the supporting means comprise displacement means and at least three support elements for an axial end of one of a plurality of printing cylinders with different diameters, the support elements each comprise an engagement point for interacting with a positioning element at the location of a support point on the positioning element, the positioning element being connectable to the printing cylinder, the positions of the support points being related to the diameter of the printing cylinder in question, and the displacement means are designed to move at least two of the support elements with respect to the support frame so as to receive positioning elements with different support point positions, corresponding to the different sized printing cylinders, wherein ink applicator means are provided on the displacement means of one of the support elements; or where the printing cylinder support unit comprises a support frame and supporting means mounted on the support frame, in which unit the supporting means comprise displacement means and at least three support elements for an axial end of one of a plurality of printing cylinders with different diameters, the support elements each comprise an engagement point for interacting with a positioning element at the location of a support point on the positioning element, the positioning element being connectable to the printing cylinder, the positions of the support points being related to the diameter of the printing cylinder in question, and the displacement means are designed to move at least two of the support elements with respect to the support frame so as to receive positioning elements with different support point positions, corresponding to the different sized printing cylinders, wherein ink applicator means are provided on the displacement means of one of the support elements. The invention further relates to the use of a positioning element for adapting a printing cylinder with a rotation axle such, that it is suitable for being received in a printing cylinder support unit, which printing cylinder support unit comprises at least three support elements for an axial end of the printing cylinder, at least two of the support elements being movable for receiving different sized printing cylinders. The invention further relates to the use of a printing cylinder comprising at least three support elements for an axial end of the printing cylinder, at least two of the support elements being movable for receiving different sized printing cylinders. Further, the invention relates to the use of a printing machine provided with a printing cylinder support unit comprising a support frame and supporting means mounted on the support frame, in which unit the supporting means comprise displacement means and at least three support elements for an axial end of one of a plurality of printing cylinders with different diameters, the support elements each comprise an engagement point for interacting with a positioning element at the location of a support point on the positioning element, the positioning element being connectable to the printing cylinder, the positions of the support points being related to the diameter of the printing cylinder in question, and the displacement means are designed to move at least two of the support elements with respect to the support frame so as to receive positioning elements with different support point positions, corresponding to the different sized printing cylinders, wherein ink applicator means are provided on the displacement means of one of the support elements.

Preferred embodiments of the invention will be explained in more detail with reference to the appended drawing, in which:

FIG. 1 diagrammatically depicts a side view of a circumferential bearing arrangement in accordance with the prior art;

Figure 1:
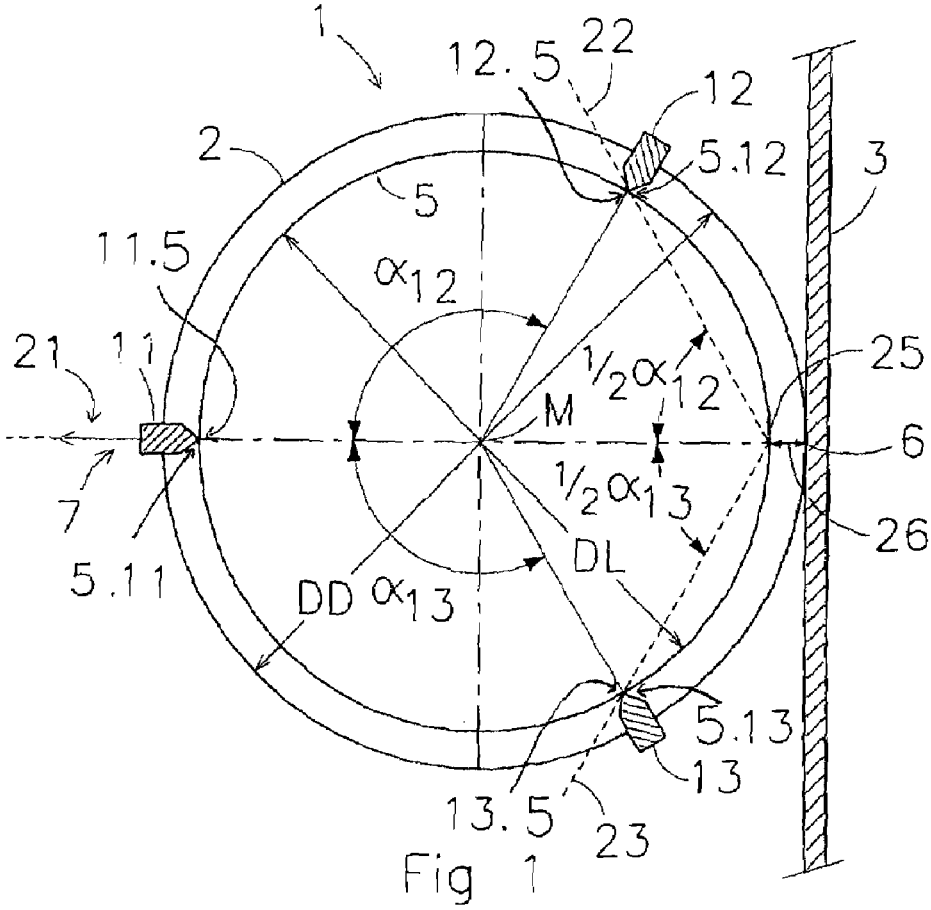
Figure 2:
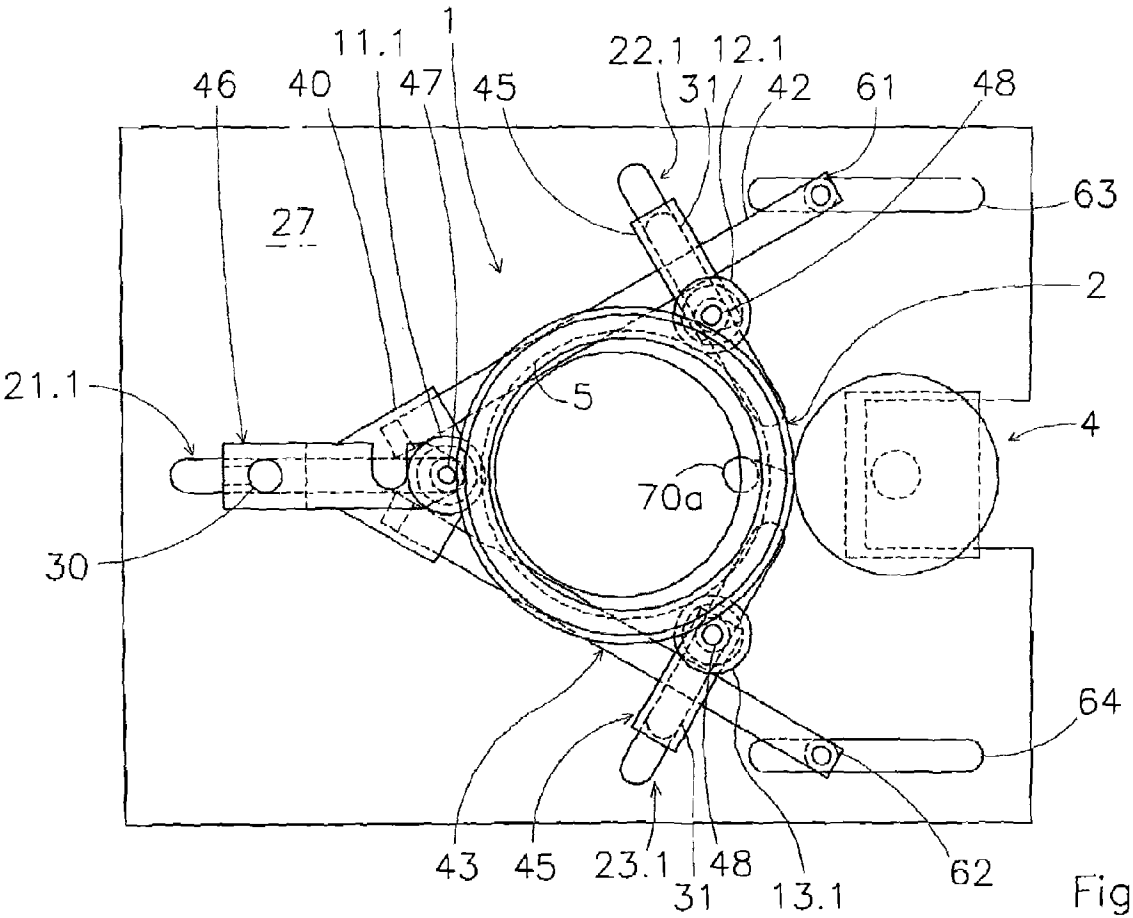
FIG. 2 shows a cross-sectional view of a printing cylinder support unit provided with a printing cylinder with bearing ring in accordance with the prior art.

FIGS. 1 and 2 show an exchangeable printing cylinder, for example a screen-printing forme, denoted by reference numeral 1, the lateral surface 2 of which is suitable for transferring ink (not shown) to a substrate 3. The substrate 3 is passed between the printing cylinder 1 and an impression roll 4, the printing cylinder and the impression roll being pressed against one another with a defined force. The printing cylinder 1 is provided with a positioning element, in this case a bearing ring, of which both figures diagrammatically depict a support surface in the form of a running surface 5.

During the printing process, the substrate 3 is guided past the rotating printing cylinder 1. In the process, the substrate 3 touches the printing cylinder 1 along a describing line on the lateral surface 2, the contact line 6. The printing cylinder 1 is mounted via support elements 11, 12 and 13, which in the prior art are designed as rollers 11.1, 12.1 and 13.1. The support elements 11, 12 and 13, or the bearing rollers 11.1, 12.1, 13.1, touch the running surface 5 of the bearing ring at support points. The radial distance from the positions of the support points to the centre axis M of the printing cylinder is equal to the radius of the running surface of the bearing ring, i.e. half the diameter $D_L$. The support point of support element 12 lies on an angle $\alpha_{12}$ along the running surface 5 of the bearing ring. This angle is defined in a polar coordinates system, in which M is the pole and the zero axis is defined by a reference axis 7 which runs from the contact line 6 through the centre M. The positive direction of this reference axis 7, and therefore the definition for $\alpha=0$, from M points away from the substrate 3, as indicated by an arrow head at the end of axis 7 in FIG. 1. Similarly, the support point of support element 13 is at an angle $\alpha_{13}$ along the running surface 5 of the bearing ring. Support element 11 lies precisely on the reference axis 7, which means that the angle $\alpha_{11}$ for this support element is equal to zero and cannot be shown in the figure.

When changing the printing cylinder 1, the support elements 11-13 move outwards along the dashed lines 21, 22 and 23; line 21 coincides with the reference axis 7. The displacement lines 21, 22 and 23 intersect one another at a reference point 25 and are at an angle which is equal to half the $\alpha$ value of the support elements in question, as indicated in FIG. 1 by $\frac{1}{2}x\alpha_{12}$ and $\frac{1}{2}x\alpha_{13}$. For support element 11, it is once again the case that its value of $\alpha$ is equal to zero and is therefore not shown in the figure.

During insertion of a printing cylinder 1 of any desired cylinder diameter $D_D$, the support elements 11, 12 and 13 move inwards along the lines 21, 22 and 23 until they come into contact with the running surface 5 of the bearing ring of the printing cylinder 1 in question. By virtue of the positioning and orientation of the lines 21, 22 and 23, the support elements 11, 12 and 13 will always come to lie at the same angle $\alpha$ with respect to the centre axis of the printing cylinder 1, irrespective of the diameters $D_D$ and $D_L$ of the printing cylinder 1 and the running surface 5 of the bearing ring. By maintaining the same difference in diameter between the printing surface of the printing cylinder and the running surface $D_L$ for the printing cylinders of different diameters $D_D$, as is customary in the prior art, the contact line 6 of the printing cylinder 1 will ultimately be located at the same position with respect to the support frame, and therefore in the operating state will always be at the same position with respect to the substrate 3 and the impression roll 4. In FIG. 1, 26 denotes the distance from the running surface 5 to the lateral surface 2; the dimension 26 is half of the difference between the diameters $D_D$ and $D_L$. In practice, this dimension is, for example, 13 mm.

Figure 3:
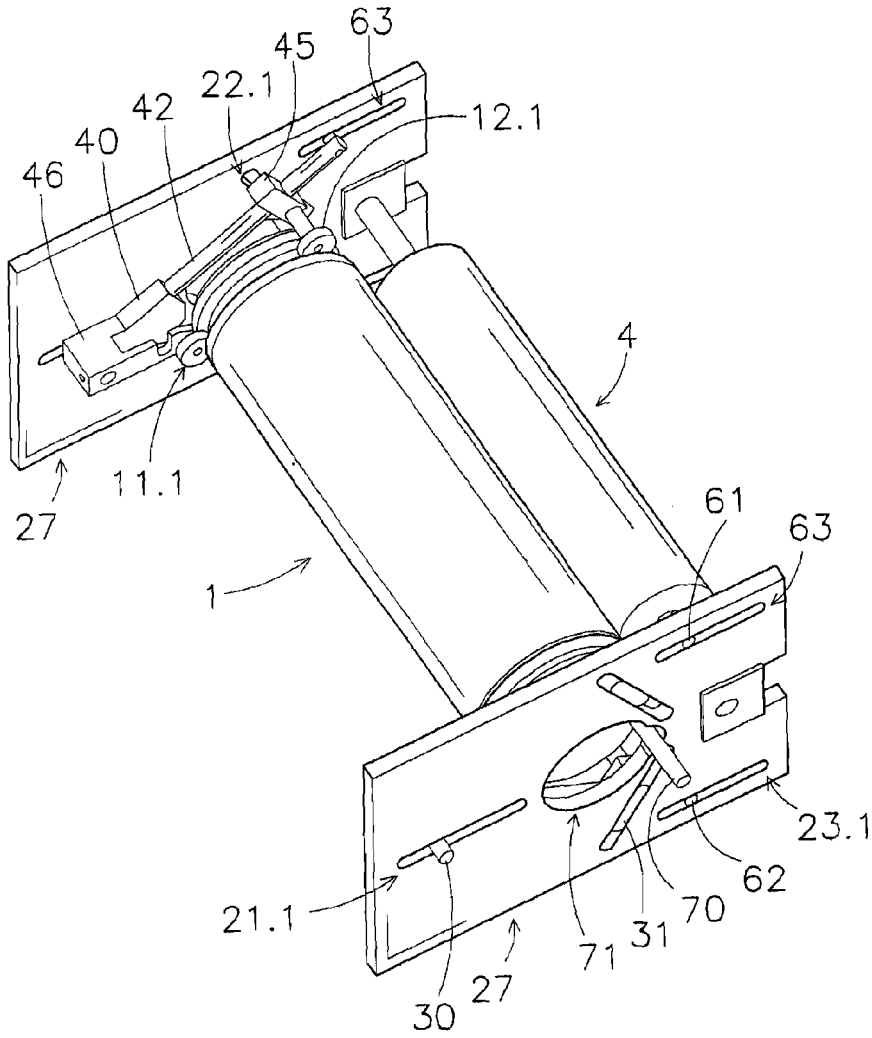
FIG. 3 shows a perspective view of the printing cylinder support unit in accordance with FIG. 2.

In the support unit as shown in FIGS. 2 and 3, the movement of the bearing rollers 11.1, 12.1 and 13.1 is guided by displacement means comprising straight slots 21.1, 22.1 and 23.1 recessed in a support or bearing frame 27. These grooves are at an angle of respectively 0°, 60° and −60° with respect to the reference axis 7. As a result, the bearing rollers 11.1, 12.1 and 13.1 always touch the running surface 5 at positions 0°, 120° C. and −120°, respectively, measured along the circumference of the running surface 5. A pin 30 is accommodated in the groove 21.1 for guidance purposes. Guide rods 31 are accommodated in grooves 22.1 and 23.1 for this purpose.

At the location of the groove 21.1 there is a substantially triangular fixing piece 40 which forms a rigid connection between rods 42 and 43. Fixing piece 40 and rods 42 and 43 form coupling means for coupling the displacements of the bearing rollers 11.1, 12.1 and 13.1. For this purpose, the rods 42 and 43 are received such that they can slide in sliding guides 45.

The fixing piece 40 is connected to the guide pin 30 via a base piece 46. A rotation pin 47 for the bearing roller 11.1 is also provided on the base piece 46. Rotation pins 48 for the bearing rollers 12.1 and 13.1 are provided at the sliding guides 45.

Locking pins 61 and 62, which are received in locking grooves 63 and 64 of the support frame 27, are provided at the ends of rods 42 and 43. These locking pins 61, 62 and locking grooves 63 and 64 prevent the rods 42, 43 from bending if the bearing rollers 11.1, 12.1 and 13.1 are pushed onto the running surface 5 of the bearing ring with a relatively high force.

FIG. 3 also shows an ink feed 70 of the ink applicator means in the form of a doctor 70*a* (diagrammatically depicted in FIG. 2). This ink feed fits through an opening 71 in the support frame 27 and through the bearing ring 5, into the printing cylinder 1, in order to apply ink from the inside.

FIGS. 2 and 3 show the operating state in which the printing cylinder 1 is supported by the roller bearings 11.1, 12.1 and 13.1. To change the printing cylinder 1, the support frame 27 will be displaced with respect to the impression roll 4. This interrupts the contact between the printing cylinder 1 and the substrate 3. Then, a displacement device (not shown) will pull the base piece 46 to the left, with the result that the bearing roller 11.1 likewise moves to the left. As a result, rods 42 and 43, which are rigidly connected to the bearing roller 11.1 by means of the triangular fixing piece 40, likewise move to the left. At the location of the slots 22.1 and 23.1 for the bearing rollers 12.1 and 13.1, this movement of the rods 42 and 43 is broken down into two directions. The first direction lies in the longitudinal axis of the rods 42 and 43 and results in a sliding movement of the rods 42, 43 through the sliding guides 45. The second component of the movement results in a movement in the direction of the grooves 22.1 and 23.1. This component of the movement pushes the pins 48 together with the bearing rollers 12.1 and 13.1 outwards. As a result, the printing cylinder 1 is released and can be removed in a way with which the person skilled in the art will be familiar.

After a new printing cylinder 1, if appropriate with a different diameter $D_D$, has been inserted, the displacement device (not shown) moves the bearing roll 11.1 back onto the running surface 5 of the bearing ring of the printing cylinder 1, with the result that the bearing rollers 12.1 and 13.1 are likewise pressed onto the running surface 5 via the rods 42 and 43, in the same way as during the opening movement.

Figure 4:
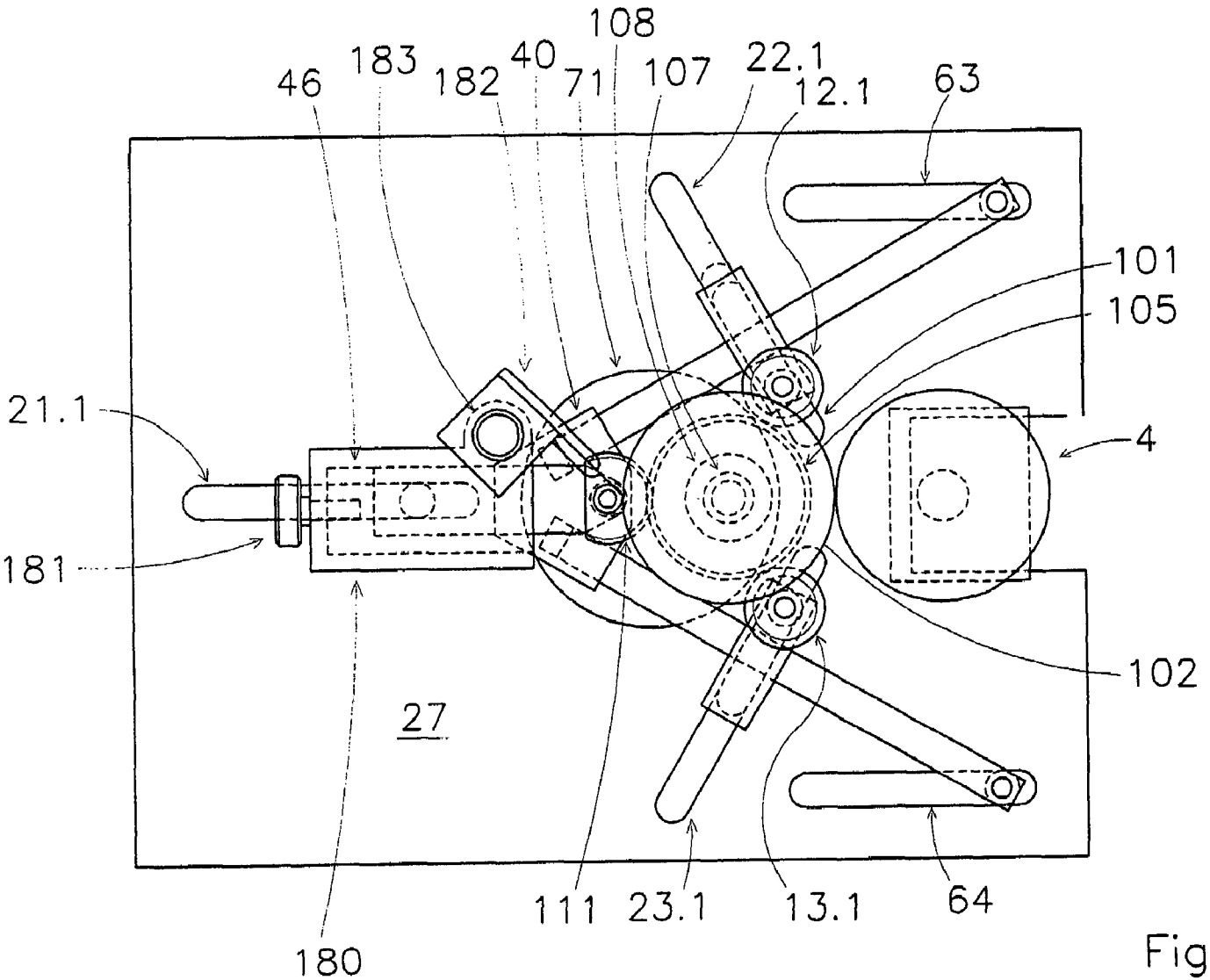
FIG. 4 shows the printing cylinder support unit from FIG. 2 provided with an intaglio printing forme and an adaptor element according to the invention.
Figure 6:
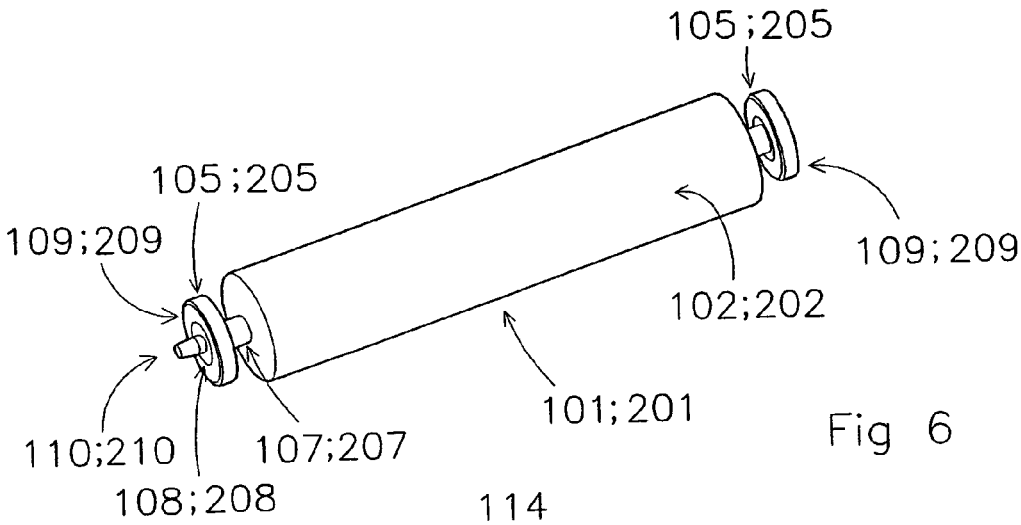
FIG. 6 shows a printing cylinder provided with adaptor elements according to the invention.

FIG. 4 shows a printing cylinder support unit as described above, provided with an intaglio printing cylinder 101 with a printing surface 102. The printing cylinder 101 is provided with a rotation axle 107 which extends along the centre axis of the printing cylinder 101 (cf. also FIG. 6). A positioning element in the form of an adaptor element 109 is provided rotatably on the rotational axle 107, by means of bearings 108. The adaptor element 109 is a substantially circular disc with a radial outer surface 105 which functions as a support surface for the support elements. Journals 110 are located at the ends of the rotation axle 107.

Bearing roller 11.1 has been replaced by a support element 111 which is partially in the form of a roller but is flattened on the side facing the base piece 46. The support element 111 is connected to the base piece 46 in a rotationally fixed, positively locking manner.

In the embodiment for intaglio printing, in accordance with FIG. 4, the printing cylinder support unit is also provided with ink applicator means. The base piece 46 is provided with an adjustable doctor carrier 180. By means of a setscrew 181, the doctor carrier 180 can be adjusted in the direction of groove 21.1 and therefore in a direction along a straight displacement line which intersects each of the printing cylinders 101 that can be received at the same circumferential position. In this case, the said circumferential position is a circumferential position which corresponds to zero degrees in the coordinate system defined above. The doctor carrier 180 is provided with an intaglio doctor 182 which is rotatably connected to the doctor carrier 180 via a pin 183. At the top side of the intaglio printing doctor 182, ink is supplied to the intaglio printing cylinder 101 via an ink feed (not shown).

In use, the non-rotating support element 111 will block the adaptor element 109 (cf. also FIG. 6) in the direction of rotation of the printing cylinder 101. By virtue of the bearing 108, the printing cylinder 101, together with its axle 107, will be able to rotate with respect to the adaptor element 109 and therefore with respect to the printing cylinder support unit as a whole. For this purpose, the printing cylinder 101 is driven in a customary way, for example via the journals 110 which are provided with a gearwheel.

Printing cylinders with different diameters can be received in the printing cylinder support unit with adaptor element 109 according to the invention. The difference in diameter between the adaptor element 109 and the associated printing cylinder 101 is advantageously equal for all these different diameters. The result of this is that the distance from the surface 102 of the printing cylinder 101 with respect to both the impression cylinder 4 and the intaglio printing doctor 182 is independent of the printing cylinder diameter used. If these distances are set correctly for one specific printing cylinder, it is no longer necessary for them to be reset for every other printing cylinder 101 of different diameter.

Figure 5:
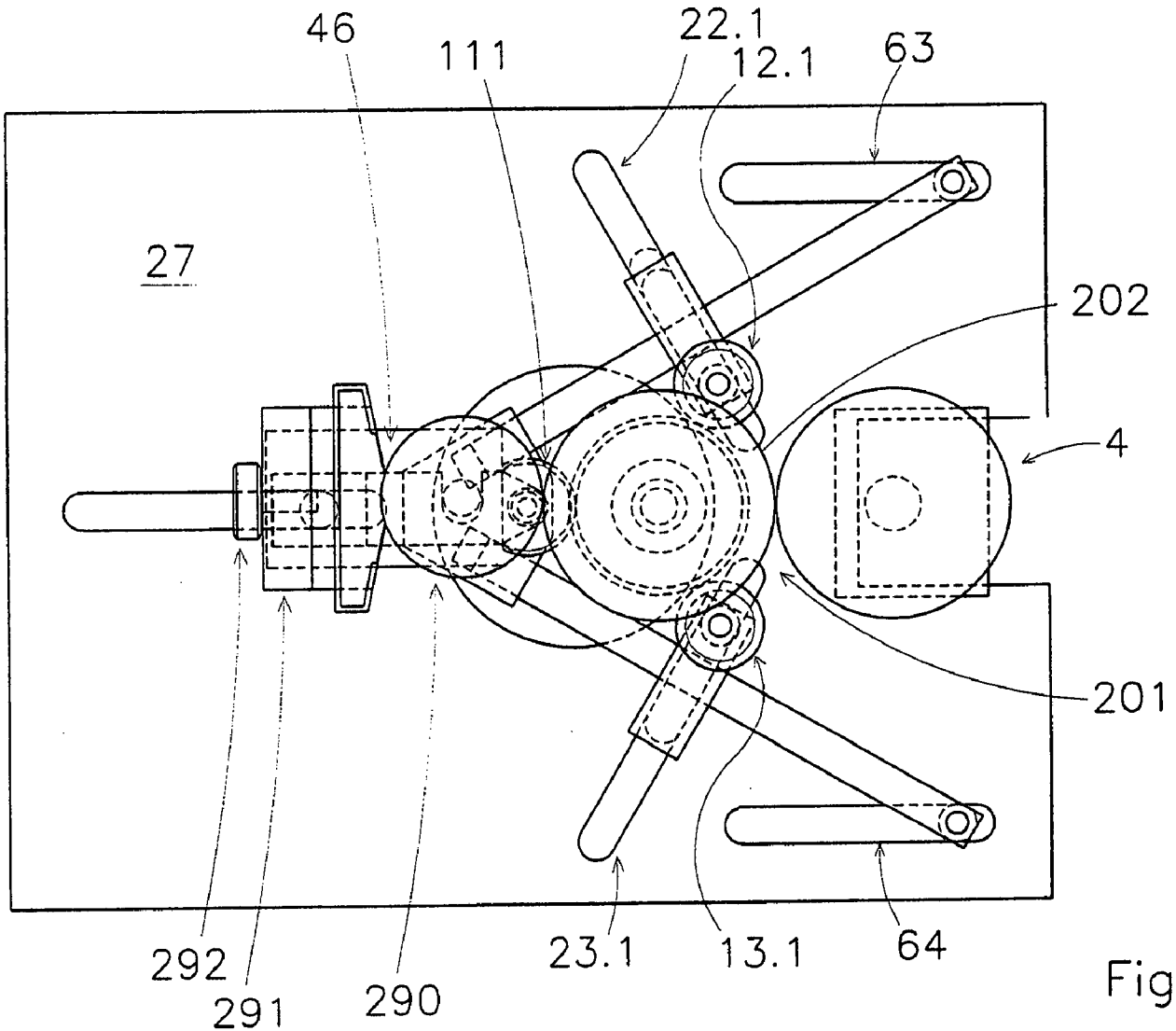
FIG. 5 shows the printing cylinder support unit from FIG. 2 provided with a flexographic printing forme and an adaptor element according to the invention.

FIG. 5 shows a similar printing cylinder support unit to that shown in the previous figures. In this case, however, the printing cylinder support unit is provided with flexographic printing means. The flexographic printing means comprise a flexographic printing cylinder 201 with a printing surface 202 (cf. also FIG. 6). The flexographic printing cylinder 201 is provided with a fixed rotation axle 207, to which an adaptor element 209 is secured rotatably via bearings 208. The rotation axle 207 ends in two journals 210.

The flexographic printing cylinder 201 is received in the printing cylinder support unit in a similar way to that which has been described in connection with the intaglio printing cylinder 101. The flexographic printing means also comprise an anilox roller 290 and a closed doctor blade chamber for the metered supply of ink 291, which are provided on the base piece 46. The position of the anilox roller 290 and the doctor blade chamber 291 can be adjusted by means of a setscrew 292 in the direction of groove 21.1 and therefore in a direction along a straight displacement line, which intersects each of the printing cylinders 101 that can be received at the same circumferential position. In this case, this circumferential position is a circumferential position corresponding to zero degrees in the coordinates system defined above. In another embodiment which is not shown, an additional roll can be used instead of the closed doctor blade chamber for applying ink to the anilox roller. The additional roll rotates in the ink and then transfers the ink to the anilox roller.

Figure 7:
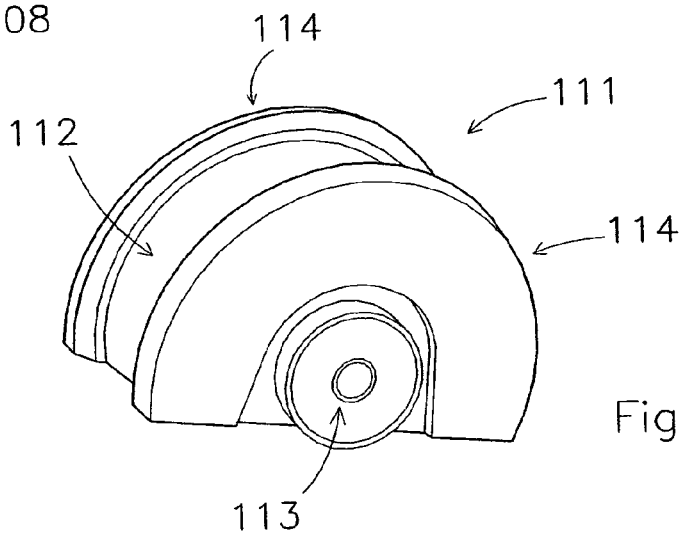
FIG. 7 shows a support element in accordance with the invention.

FIG. 7 shows the support element 111 in detail. The support element 111 is provided with a partially cylindrical engagement surface 112 and a cylindrical securing point 113. The radial distance from the centre of the cylindrical securing point 113 to the engagement surface 112 is equal to the corresponding distance from the roller bearings 12.1 and 13.1. The support element 111 is also provided with raised edges 114 which, in use, engage around the adaptor element 109, 209 in order to fix it, and therefore the printing cylinder 101, in the axial direction.

Figure 8:
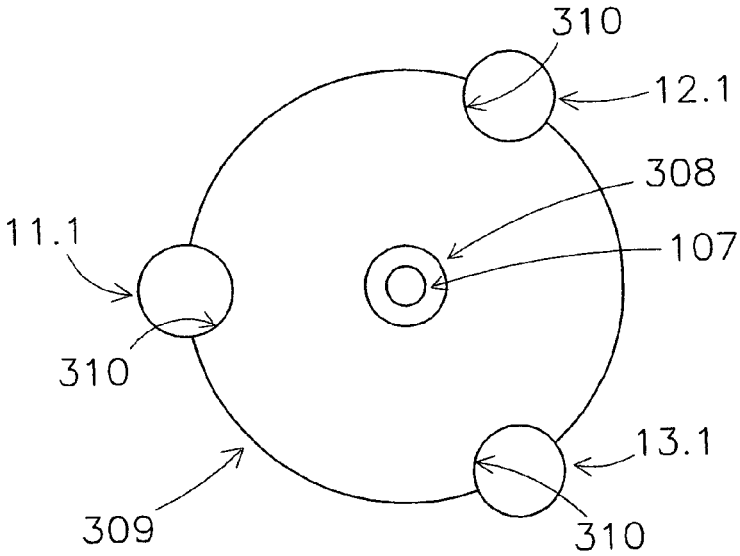
FIG. 8 shows an alternative adaptor element in accordance with the invention.

FIG. 8 shows an alternative adaptor element 309 in the form of a disc provided with semicircular cutouts 310. The diameter of the cutouts 310 corresponds to the external diameter of the bearing rollers 11.1, 12.1 and 13.1. The points on the cutouts 310 which are located furthest inwards in the radial direction with respect to the adaptor element 309 are to be considered as support points for the support elements, i.e. the bearing rollers 11.2, 12.1 and 13.1.

The adaptor element 309 can be secured to an axle 107, 207 of a printing cylinder, which is not shown in more detail. In this case, the axle 107, 207 is mounted rotatably with respect to the support element 309 by means of a bearing 308. An advantage of this embodiment is that the bearing rollers which are also used for a circumferential bearing arrangement do not have to be exchanged in order nevertheless to obtain a rotationally fixed connection to an adaptor element.

In addition to the preferred embodiments shown and described above, numerous embodiments and variants are also possible. For example, the printing cylinder support unit can advantageously be used in a similar way via an adaptor element for other printing formes which are provided with a rotation axle, such as offset printing cylinders and printing cylinders for letterpress printing. The support elements for the circumferential bearing arrangement may also, for example, be sliding bearings. In the embodiment with an adaptor element, the support elements may also be formed differently in order to exert a greater frictional force on the positioning surface of the adaptor element, to form different positively locking connections or to be fixedly connected to an adaptor element with the aid of securing means, such as bolts.

As an alternative to three displaceable support elements, it is also possible for only two support elements to be displaceable. In this case, the non-displaceable support element will generally be located in the vicinity of a printing position, i.e. in the vicinity of the impression roller. It is also possible for a third support point of this type to be a ring, as described in Dutch patent NL 1 021 874.

The rotation axle of the printing cylinder may also be received in a rotationally fixed manner, i.e. non-rotatably, in an adaptor element. In that case, a printing cylinder is mounted rotatably with respect to the axle. The shape of the adaptor element is not restricted to discs. For the purposes of the invention, it is only the positions of the support points on the adaptor element which are important. Working on the basis of support elements which are all of substantially the same shape and size, the support positions on an adaptor element will lie on an imaginary circle which is concentric with the printing cylinder that is to be supported. However, it is also possible for a support element to be replaced by one of a different shape and/or size. In that case, the support positions are no longer located on an imaginary circle of this type.

The ink applicator means may also be provided on one of the other displacement means. The displacement means themselves do not necessarily have to be moveable along a straight displacement line, but rather may also, for example, move along a curved path, as is known in the prior art.

It is also possible to use embodiments in which the displacement means are not coupled to one another mechanically, but rather in some other way, for example pneumatically. In alternative embodiments of this type too, the support elements are moved along the defined lines 21, 22, 23 in FIG. 1 towards their support positions on the defined circle 5 that is concentric with the printing cylinder to be supported.

Therefore, the invention provides a printing cylinder support unit which, by means of an adaptor element, is easy to use for both printing cylinders with an end ring or bearing ring and for printing cylinders with a rotation axle. The adaptor element according to the invention is simple and versatile. The adaptor element means that once the position of the impression cylinder and of any ink applicator means has been set, this position is valid for printing cylinders of different diameters. The ink applicator means may advantageously be provided on the displacement means of one of the support elements. This not only saves on the number of components but also ensures accurate setting of the ink applicator means with respect to the printing cylinders.

The invention claimed is:

1. Printing cylinder support unit for a printing machine, comprising a support frame, and supporting means mounted on the support frame, wherein the supporting means comprise displacement means and at least three support elements for an axial end of one of a plurality of printing cylinders with different diameters, the support elements each comprise an engagement point for interacting with one of a plurality of positioning elements at the location of a support point on the positioning element, the one positioning element being connectable to one of the plurality of the printing cylinders, the positions of the support points being related to the diameter of the one printing cylinder, and the displacement means are adapted to move at least two of the support elements with respect to the support frame so as to receive another one of the plurality of positioning elements, the other one of the plurality of positioning elements having different support point positions, corresponding to the different sized printing cylinders, wherein the one positioning element is connectable to the support elements in a rotationally fixed manner, and comprises axle support means for accommodating a rotation axle of one of the printing cylinders.

2. Printing cylinder support unit according to claim 1, wherein at least one of the at least three support elements can be frictionally connected to the positioning element.

3. Printing cylinder support unit according to claim 2, wherein the at least one of the three support elements is at least partially in the shape of a roller, wherein at least one of the three support element is mounted in a rotationally fixed manner with respect to the support frame.

4. Printing cylinder support unit according to claim 1, wherein at least one of the support elements can be connected in a positively locking manner to the positioning element.

5. Printing cylinder support unit according to claim 1, in which the positioning element includes the axle support means for receiving a rotation axle of one of the printing cylinders.

6. Printing machine comprising a printing cylinder support unit according to claim 1.

7. Printing cylinder support unit according to claim 1, further comprising a rotationally fixed connection between the one positioning element and one of the support elements, wherein the rotationally fixed connection is selected from the group consisting of a frictional connection, a positively locking connection, a fixed connection with the aid of securing means and combinations thereof.

8. Printing cylinder support unit for a printing machine, comprising a support frame, and supporting means mounted on the support frame, wherein the supporting means comprise displacement means and at least three support elements for an axial end of one of a plurality of printing cylinders with different diameters, the support elements each comprise an engagement point for interacting with one of the plurality of the positioning elements at the location of a support point on the positioning element, the one positioning element being connectable to the one printing cylinder, the positions of the support points being related to the diameter of the one printing cylinder in question, and the displacement means are adapted to move at least two of the support elements with respect to the support frame so as to receive another one of the plurality of positioning elements, the other one of the plurality of positioning elements having different support point positions, corresponding to the different sized printing cylinders, wherein ink applicator means are provided on the displacement means of one of the support elements.

9. Printing cylinder support unit according to claim 8, in which the displacement means on which the ink applicator means are provided can move along a straight displacement line which intersects each of the printing cylinders which can be received at a circumferential position which is the same for each of the printing cylinders.

10. Printing cylinder support unit according to claim 8 wherein the one positioning element further comprises axle support means for receiving a rotation axle of one of the printing cylinders.

11. Printing cylinder support unit according to claim 10, wherein the axle support means comprise bearing means for rotatably accommodating the rotation axle of one of the printing cylinders.

12. Printing cylinder support unit according to claim 10, wherein the one positioning element comprises a substantially round disc.

13. Printing machine comprising:

a printing cylinder support unit according to claim 8.

14. A method of using a positioning element for adapting a printing cylinder with a rotation axle such, that it is suitable for being received in a printing cylinder support unit, comprising:

selecting a positioning element;

providing the selected positioning element on an axle of a printing cylinder; and providing a printing cylinder support unit which comprises at least three support elements for an axial end of the printing cylinder, at least two of the support elements being movable for receiving different sized printing cylinders.

15. The method according to claim 14 further comprising:

providing the printing cylinder with the positioning element in the printing cylinder support unit of a printing machine; and printing on a substrate with the printing machine.

* * * * *